US009625927B2

(12) United States Patent
Imanishi et al.

(10) Patent No.: US 9,625,927 B2
(45) Date of Patent: Apr. 18, 2017

(54) DRIVE CIRCUIT

(71) Applicant: Mitsubishi Electric Corporation, Tokyo (JP)

(72) Inventors: Motoki Imanishi, Fukuoka (JP); Kenji Sakai, Fukuoka (JP); Takaki Nakashima, Fukuoka (JP)

(73) Assignee: Mitsubishi Electric Corporation, Tokyo (JP)

( * ) Notice: Subject to any disclaimer, the term of this patent is extended or adjusted under 35 U.S.C. 154(b) by 14 days.

(21) Appl. No.: 14/754,110

(22) Filed: Jun. 29, 2015

(65) Prior Publication Data

US 2016/0116929 A1 Apr. 28, 2016

(30) Foreign Application Priority Data

Oct. 27, 2014 (JP) ..... 2014-218020

(51) Int. Cl.
*G05F 3/26* (2006.01)
*G05F 1/59* (2006.01)

(52) U.S. Cl.
CPC ..... *G05F 1/59* (2013.01)

(58) Field of Classification Search
CPC ..... G05F 3/00; G05F 3/16; G05F 3/20; G05F 3/26; G05F 3/262; G05F 3/265; G05F 3/267
USPC ..... 323/312, 313, 315
See application file for complete search history.

(56) References Cited

U.S. PATENT DOCUMENTS 4,605,907 A * 8/1986 Rosenthal ..... H03F 1/303 330/257
5,587,648 A * 12/1996 Jinbo ..... G11C 5/147 323/269
5,909,112 A * 6/1999 Kiyota ..... G05F 1/573 323/225
7,443,149 B2 * 10/2008 Nishimura ..... G05F 1/575 323/280
7,560,980 B2 * 7/2009 Hitomi ..... H03F 1/305 323/316
8,138,818 B2 3/2012 Tsunoda et al.
2011/0121907 A1 * 5/2011 Kanai ..... G01C 19/56 331/65

FOREIGN PATENT DOCUMENTS

JP 2009-011049 A 1/2009

* cited by examiner

*Primary Examiner* — Adolf Berhane
(74) *Attorney, Agent, or Firm* — Studebaker & Brackett PC

(57) ABSTRACT

A drive circuit of the present invention, which drives a switching device in response to a control signal, includes: a current mirror circuit including an output transistor connected to a control electrode of the switching device and a reference transistor that is connected to the output transistor in a current mirror manner and supplies a mirror current to the output transistor; and a potential change circuit that is connected to the reference transistor and changes a control potential of the output transistor from a potential during mirror operation of the current mirror circuit.

15 Claims, 13 Drawing Sheets

DRIVE CIRCUIT

BACKGROUND OF THE INVENTION

Field of the Invention

The present invention relates to gate drive control for driving a switching device.

Description of the Background Art

A switching device has two drive modes: on-resistance drive and constant current drive. The on-resistance drive mode causes a large drive current to flow at the initial time of gate driving so that the occurrence of Electro-Magnetic Interference (EMI) noise poses a problem.

On the other hand, while the constant current drive mode reduces the EMI noise at the initial phase of gate driving, there is a problem that the constant current drive mode requires a very large device size compared with the on-resistance drive mode.

As such, Japanese Patent Application Laid-Open No. 2009-11049 proposes a drive circuit that uses both the constant current drive and on-resistance drive modes and switches between them in use as needed.

SUMMARY OF THE INVENTION

An object of the present invention is to provide a drive circuit that uses both constant current drive mode and on-resistance drive mode and does not require a large circuit area.

The drive circuit of the present invention drives a switching device in response to a control signal. The drive circuit of the present invention includes a current mirror circuit and a potential change circuit. The current mirror circuit includes an output transistor and a reference transistor. The output transistor is connected to a control electrode of the switching device. The reference transistor, which is connected to the output transistor in a current mirror manner, supplies a mirror current to the output transistor. The potential change circuit connected to the reference transistor changes a control potential of the output transistor from a potential during mirror operation of the current mirror circuit.

According to the present invention, the potential change circuit changes the control potential of the output transistor so that the output transistor can switch between the constant current drive and the on-resistance drive. Accordingly, the drive circuit can be provided that uses both the constant current drive and on-resistance drive modes with a small circuit area.

These and other objects, features, aspects and advantages of the present invention will become more apparent from the following detailed description of the present invention when taken in conjunction with the accompanying drawings.

DESCRIPTION OF THE PREFERRED EMBODIMENTS

<A. First Preferred Embodiment>

<A-1. Configuration>

Figure 1:
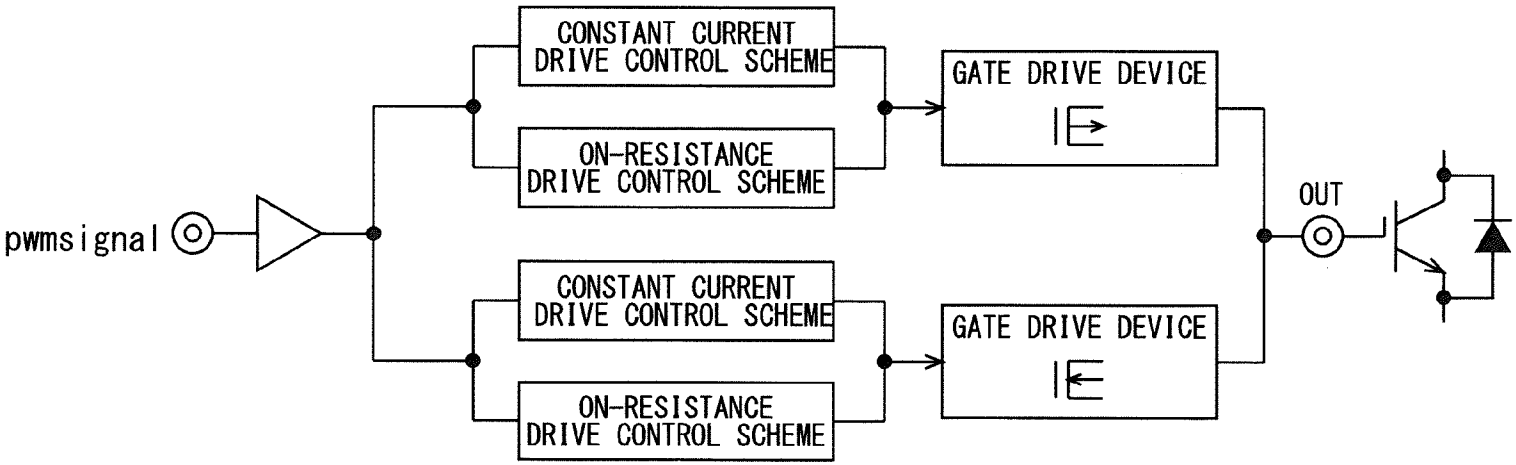
FIG. 1 is a block diagram illustrating a configuration of a drive circuit according to a first preferred embodiment of the present invention.

FIG. 1 is a block diagram illustrating a configuration of a drive circuit 101 according to a first preferred embodiment of the present invention. The drive circuit includes, as a gate drive device, a P-channel MOSFET 1 to perform source control and an N-channel MOSFET 2 to perform sink control. Each of the P-channel MOSFET 1 and the N-channel MOSFET 2 has a constant current drive control scheme and an on-resistance drive control scheme. That is, a single MOSFET is configured to be used for both constant current drive and on-resistance drive.

Figure 2:
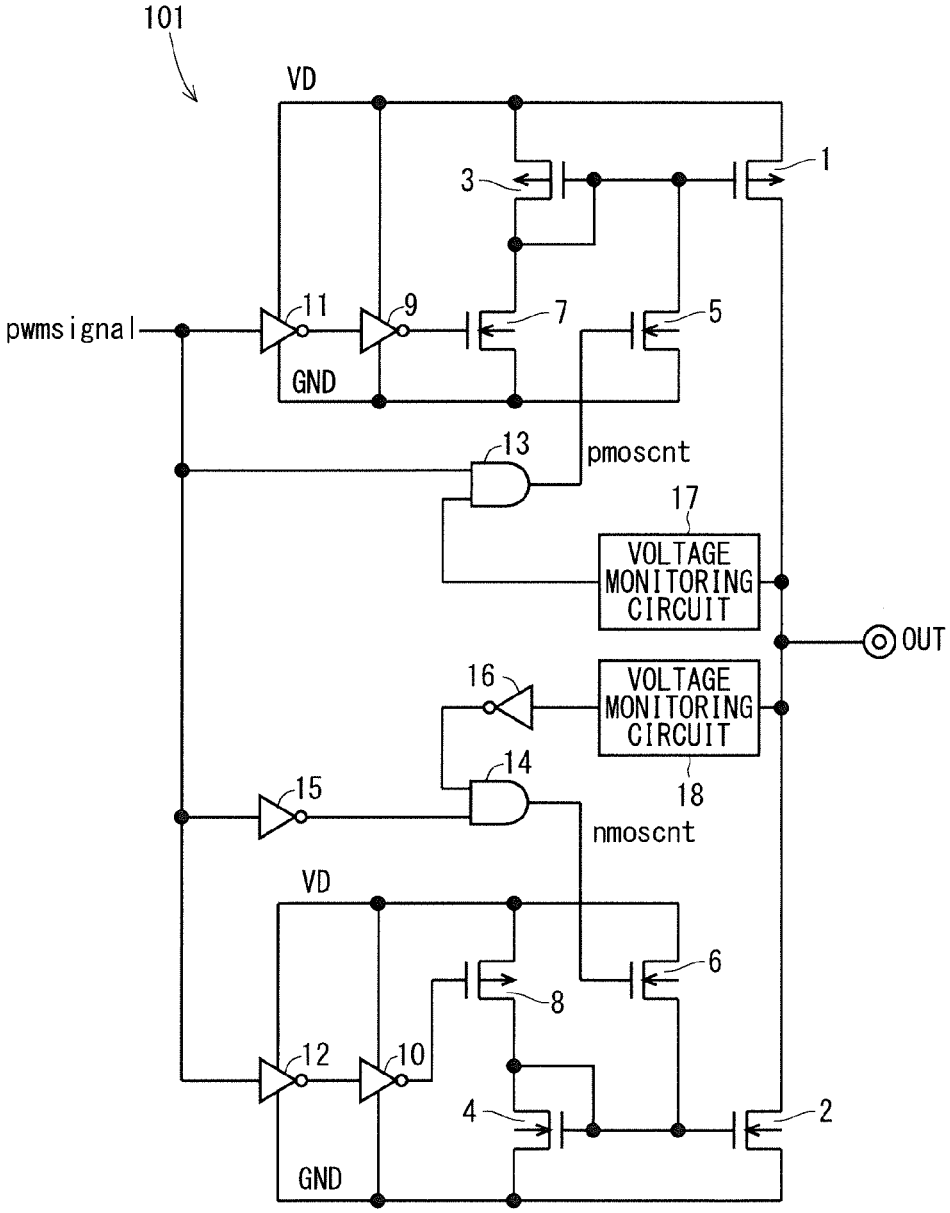
FIG. 2 is a circuit diagram of the drive circuit according to the first preferred embodiment of the present invention.

FIG. 2 is a circuit diagram of the drive circuit 101. The drive circuit 101 drives a switching device connected to an output terminal "out" in response to a control signal "pwm-signal". The drive circuit 101 includes a source-side circuit and a sink-side circuit, and the configuration of the sink-side circuit is symmetrical to that of the source-side circuit, being provided with opposing polarity. Accordingly, the configuration of the source-side circuit is mainly described below.

The drive circuit 101 includes a current mirror circuit and a potential change circuit that changes a control potential of an output transistor (P-channel MOSFET 1) of the current mirror circuit from a potential during mirror operation of the current mirror circuit.

The current mirror circuit includes the P-channel MOSFET 1 as the output transistor and a P-channel MOSFET 3 as a reference transistor that is connected to the P-channel MOSFET 1 in a current mirror manner and supplies a mirror current to the P-channel MOSFET 1. Specifically, gate electrodes of the P-channel MOSFET 3 and the P-channel MOSFET 1 are connected to each other, and a gate electrode and a drain electrode of the P-channel MOSFET 3 are short-circuited.

The drain electrode of the P-channel MOSFET 3 is connected to a drain electrode of an N-channel MOSFET 7. The N-channel MOSFET 7, a source electrode of which is grounded to GND, is a third transistor constituting a bias current generating circuit for the current mirror circuit. The control signal "pwmsignal" is input to a gate electrode of the N-channel MOSFET 7 through two NOT gates 9 and 11, and the N-channel MOSFET 7 is turned on in response to the control signal "pwmsignal" to generate a bias current for the current mirror circuit.

The drive circuit 101 further includes a voltage monitoring circuit 17 for monitoring a gate voltage of the switching device to be driven and an N-channel MOSFET 5 (first transistor) a drain electrode of which is connected to the gate electrode of the P-channel MOSFET 1.

The voltage monitoring circuit 17 outputs a logic level "H" (hereinafter, "H") when the gate voltage of the switching device to be driven exceeds a threshold. The output of the voltage monitoring circuit 17 is input to an AND gate 13. The AND gate 13 receives the output of the voltage monitoring circuit 17 and the control signal "pwmsignal". An output terminal of the AND gate 13 is connected to a gate electrode of the N-channel MOSFET 5.

Thus, the N-channel MOSFET 5 is turned on when both the control signal "pwmsignal" and the output of the voltage monitoring circuit 17 are at logic high "H". This causes a gate potential of the P-channel MOSFET 1 to change from the same potential as that of the P-channel MOSFET 3, and the P-channel MOSFET 1 drives the switching device to be driven by applying a voltage corresponding to its on-resistance. In this manner, the N-channel MOSFET 5 operates as the potential change circuit that disconnects the gate potential of the P-channel MOSFET 1 from the gate potential of the P-channel MOSFET 3. The voltage monitoring circuit 17 and the AND gate 13 operate as a control circuit that controls whether the N-channel MOSFET 5 is turned on or off.

The foregoing has described the configuration of the source-side circuit of the drive circuit 101. The configuration of the sink-side circuit is substantially similar to that of the source-side circuit. The sink side of the drive circuit 101 includes a current mirror circuit and a potential change circuit that changes a control potential of the N-channel MOSFET 2 as an output transistor of the current mirror circuit from a potential during mirror operation of the current mirror circuit.

The sink-side current mirror circuit includes the N-channel MOSFET 2 as the output transistor and an N-channel MOSFET 4 as a reference transistor that is connected to the N-channel MOSFET 2 in a current mirror manner and supplies a mirror current to the N-channel MOSFET 2. Specifically, gate electrodes of the N-channel MOSFET 2 and the N-channel MOSFET 4 are connected to each other, and a gate electrode and a drain electrode of the N-channel MOSFET 4 are short-circuited.

The drain electrode of the N-channel MOSFET 4 is connected to a drain electrode of a P-channel MOSFET 8. The P-channel MOSFET 8, a source electrode of which is connected to a power supply VD, is a bias current generating circuit for the current mirror circuit. The control signal "pwmsignal" is input to a gate electrode of the P-channel MOSFET 8 through two NOT gates 10 and 12, and the P-channel MOSFET 8 is turned on in response to the control signal "pwmsignal" to generate a bias current for the current mirror circuit.

The drive circuit 101 further includes a voltage monitoring circuit 18 for monitoring a gate voltage of the switching device to be driven and an N-channel MOSFET 6 (first transistor) a drain electrode of which is connected to the gate electrode of the N-channel MOSFET 2.

The voltage monitoring circuit 18 outputs a logic level "H" when the gate voltage of the switching device to be driven is greater than or equal to a threshold. The output of the voltage monitoring circuit 18 is input to an AND gate 14 through a NOT gate 16. The AND gate 14 receives the output of the voltage monitoring circuit 18 as well as the control signal "pwmsignal" through a NOT gate 15. An output terminal of the AND gate 14 is connected to a gate electrode of the N-channel MOSFET 6.

Thus, the N-channel MOSFET 6 is turned on when both the control signal "pwmsignal" and the output of the voltage monitoring circuit 18 are at a logic level "L" (hereinafter, "L"). This causes a gate potential of the N-channel MOSFET 2 to change from the potential during mirror operation of the current mirror circuit, i.e., a gate potential of the N-channel MOSFET 4. The N-channel MOSFET 2 then drives the switching device to be driven by applying a voltage corresponding to its on-resistance. In this manner, the N-channel MOSFET 6 operates as the potential change circuit that disconnects the gate potential of the N-channel MOSFET 2 from the gate potential of the N-channel MOSFET 4. The voltage monitoring circuit 18 and the AND gate 14 operate as a control circuit that controls whether the N-channel MOSFET 6 is turned on or off.

<A-2. Operation>

Figure 3:
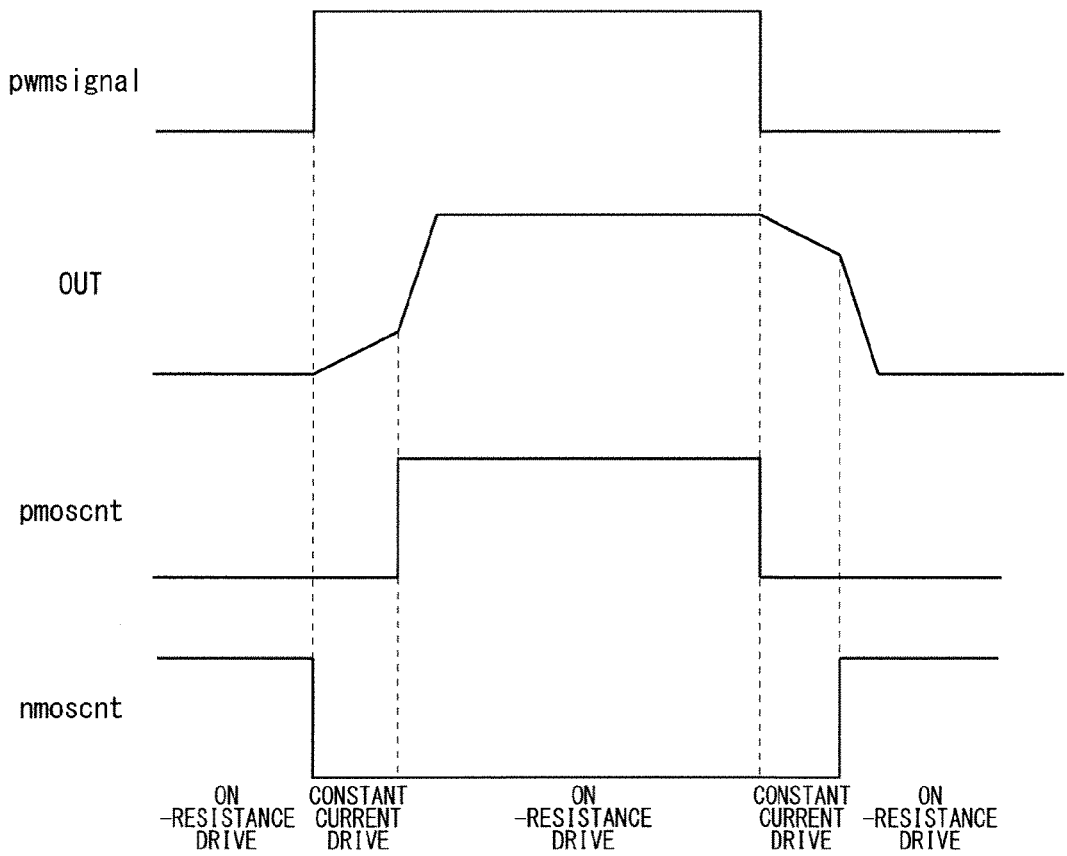
FIG. 3 is a diagram illustrating the operation of the drive circuit according to the first preferred embodiment of the present invention.

FIG. 3 shows waveform diagrams of the control signal "pwmsignal", a gate voltage "OUT" of the switching device to be driven, a gate voltage "pmoscnt" of the N-channel MOSFET 5 as the potential change circuit, and a gate voltage "nmoscnt" of the N-channel MOSFET 6 as the potential change circuit in the sink side.

When the control signal "pwmsignal" goes "H", the N-channel MOSFET 7 is turned on and the bias current flows through the current mirror circuit. A drain current substantially equal to that of the P-channel MOSFET 3 also flows through the P-channel MOSFET 1 and the switching device is driven with a constant current.

The constant current drive raises the gate voltage "OUT" of the switching device. When the voltage monitoring circuit detects that the gate voltage "OUT" has exceeded the threshold, the gate voltage "pmoscnt" goes "H", the N-channel MOSFET 5 is turned on, and the P-channel MOSFET 1 performs the on-resistance drive.

When the control signal "pwmsignal" then goes "L", the gate voltage "pmoscnt" goes "L", the N-channel MOSFET 5 is turned off, and no bias current for the current mirror circuit is generated. Meanwhile, in the sink side, the P-channel MOSFET 8 is turned on and the current mirror circuit performs the constant current drive. Thereafter, the gate voltage "OUT" is gradually reduced.

The voltage monitoring circuit 18 outputs "L" when it detects that the gate voltage "OUT" is less than the threshold. The output above is input to the AND gate 14 through the NOT gate 16 and an output "nmoscnt" of the AND gate 14 goes "H". The N-channel MOSFET 6 is then turned on and the N-channel MOSFET 2 performs the on-resistance drive.

<A-3. Voltage Monitoring Circuit>

The voltage monitoring circuits 17, 18 monitor a control voltage for (i.e., the gate voltage of) the switching device to be driven and determine whether or not the control voltage is greater than or equal to the threshold. The voltage monitoring circuits 17, 18 may be comprised of a logic device with a threshold. Such a device facilitates the configuration of the circuit and high-speed operation of the logic device can reduce the delay of a gate voltage monitoring function.

Figure 4:
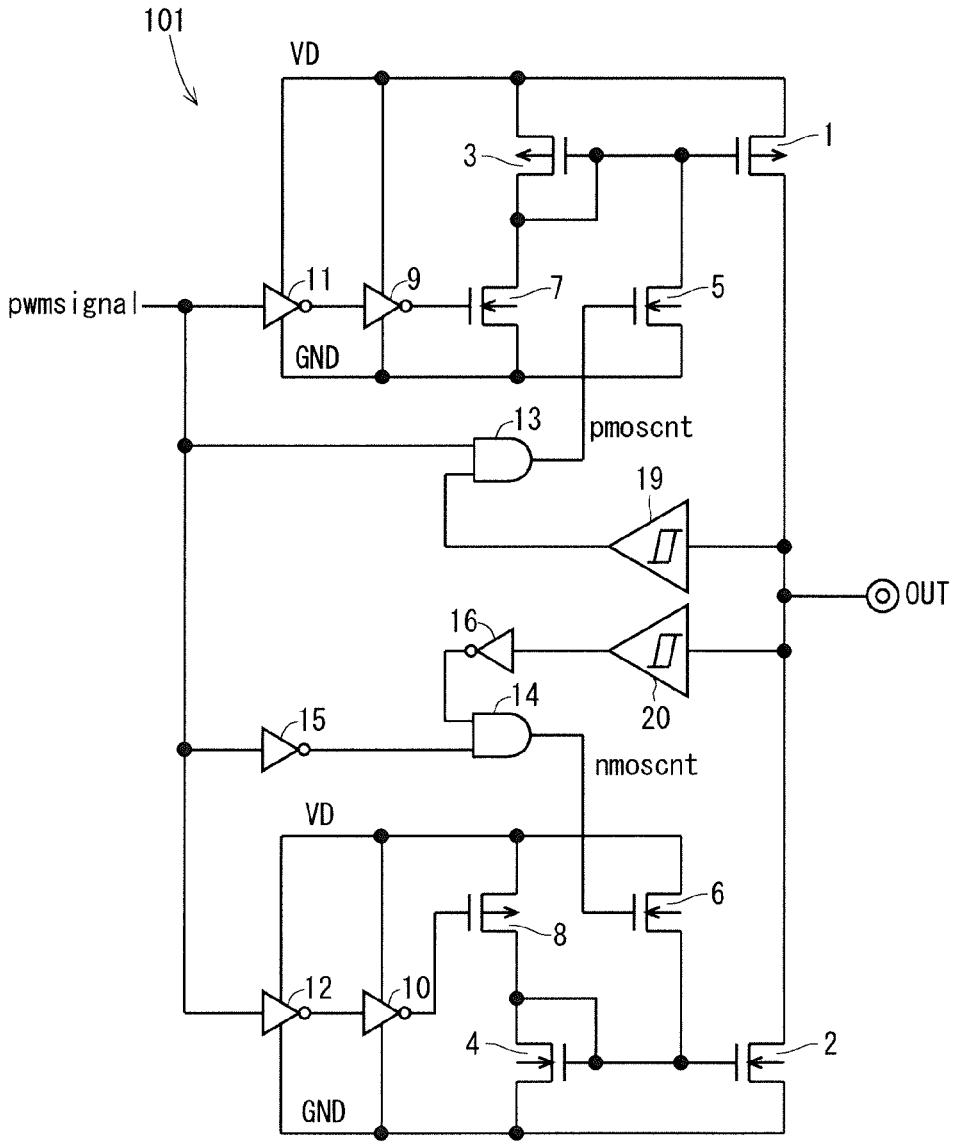
FIGS. 4 and 5 are circuit diagrams of the drive circuits according to the first preferred embodiment of the present invention.

The voltage monitoring circuits 17 and 18 may also be comprised of Schmitt circuits 19 and 20, respectively, as shown in FIG. 4, and this simplifies the circuits. The response speed of the Schmitt circuit depends on device characteristics and this can reduce switching delay.

Figure 5:
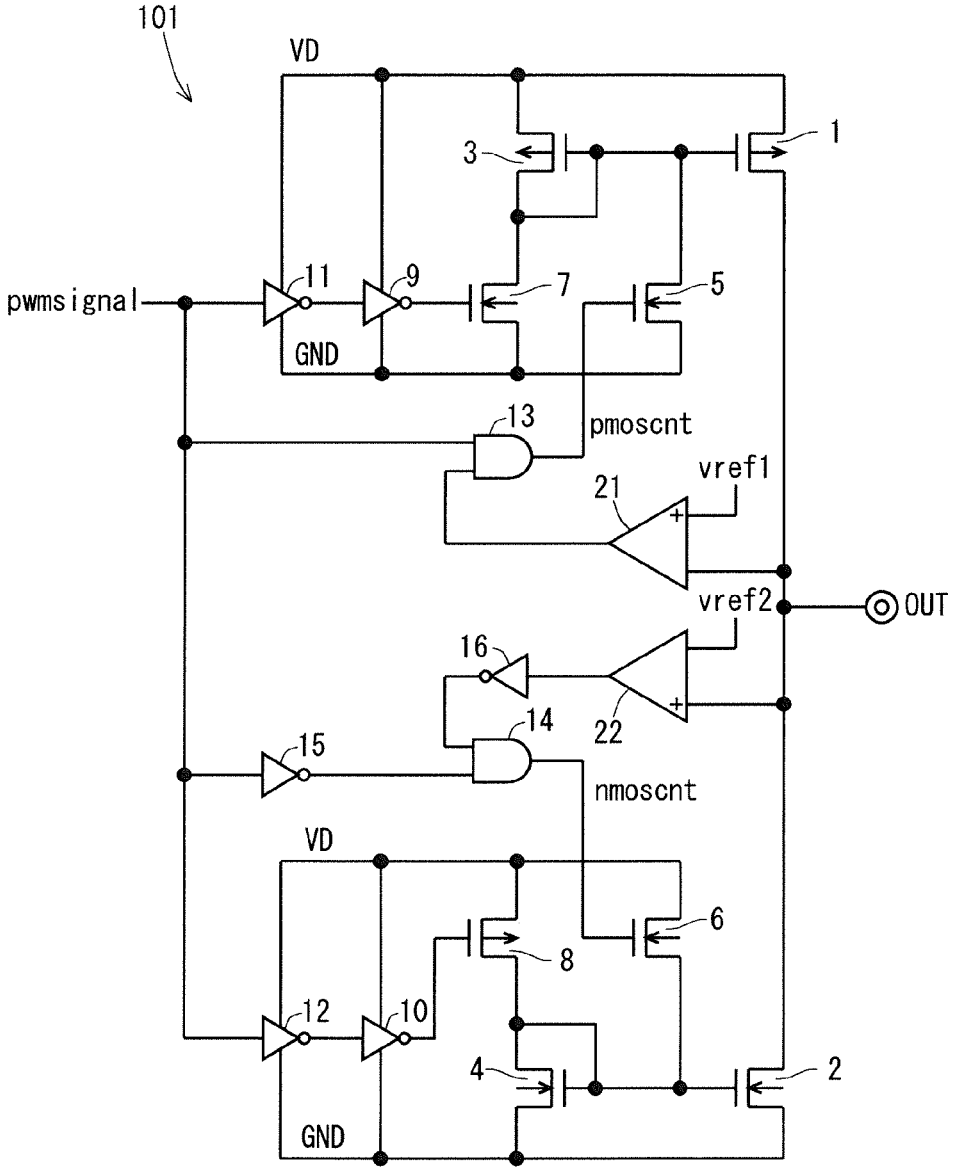

The voltage monitoring circuits 17 and 18 may also be comprised of comparators 21 and 22, respectively, as shown in FIG. 5, and this enables highly accurate threshold setting that does not depend on the supply voltage. Thus, the constant current drive mode can operate accurately in the range affected by EMI noise, thereby enhancing the noise reduction effect.

<A-4. Advantageous Effects>

The drive circuit 101 according to the first preferred embodiment includes: a first current mirror circuit including the output transistor (P-channel MOSFET 1) connected to a control electrode of the switching device and the reference transistor (P-channel MOSFET 3) that is connected to the output transistor in a current mirror manner and supplies a mirror current to the output transistor; and the potential change circuit (N-channel MOSFET 5) that is connected to the reference transistor and changes the control potential of the output transistor from the potential during mirror operation of the first current mirror circuit. Thus, the potential change circuit changes the control potential of the output transistor so that the output transistor can be operated by switching between constant current drive use and on-resistance drive use. Accordingly, the drive circuit can be provided that uses both constant current drive mode and on-resistance drive mode with a small circuit area.

The potential change circuit includes the first transistor (N-channel MOSFET 5) a first current electrode of which is connected to a control line common to the reference transistor and the output transistor and the control circuit that controls whether the first transistor is turned on or off. Thus, when the first transistor is turned off, the constant current drive is performed using the mirror current of the current mirror circuit; when the first transistor is turned on, the on-resistance drive is performed using the on-resistance of the output transistor.

The control circuit includes the voltage monitoring circuits 17, 18 for monitoring the control voltage for the switching device. When the voltage monitoring circuit 17 detects in the source side that the control voltage is greater than a threshold voltage, the first transistor (N-channel MOSFET 5) is turned on. When the voltage monitoring circuit 18 detects in the sink side that the control voltage is less than a threshold voltage, the first transistor (N-channel MOSFET 6) is turned on. Thus, switching between the constant current drive and the on-resistance drive is enabled based on the control voltage.

The voltage monitoring circuits 17, 18 comprised of a logic device with a threshold facilitate the configuration of the circuit, and high-speed operation of the logic device can reduce the delay of a gate voltage monitoring function.

Configuring the voltage monitoring circuits 17 and 18 using the Schmitt circuits 19 and 20, respectively, simplifies the circuits. The response speed of the Schmitt circuits 19, 20 depends on device characteristics and this reduces switching delay.

The voltage monitoring circuits 17 and 18 comprised of the comparators 21 and 22, respectively, enable highly accurate threshold setting that does not depend on the supply voltage. Thus, the constant current drive mode can operate accurately in the range affected by EMI noise, thereby enhancing the noise reduction effect.

Since the drive circuit 101 includes the bias current generating circuit for generating the bias current flowing through the reference transistor (P-channel MOSFET 3), the constant current drive can be performed by the output transistor (P-channel MOSFET 1) using the mirror current of the current mirror circuit.

The third transistor (N-channel MOSFET 7) connected in series with the reference transistor (P-channel MOSFET 3) is used as the bias current generating circuit so that a drain current when the N-channel MOSFET 7 is turned on is used as the bias current.

<B. Second Preferred Embodiment>

<B-1. Configuration>

Figure 6:
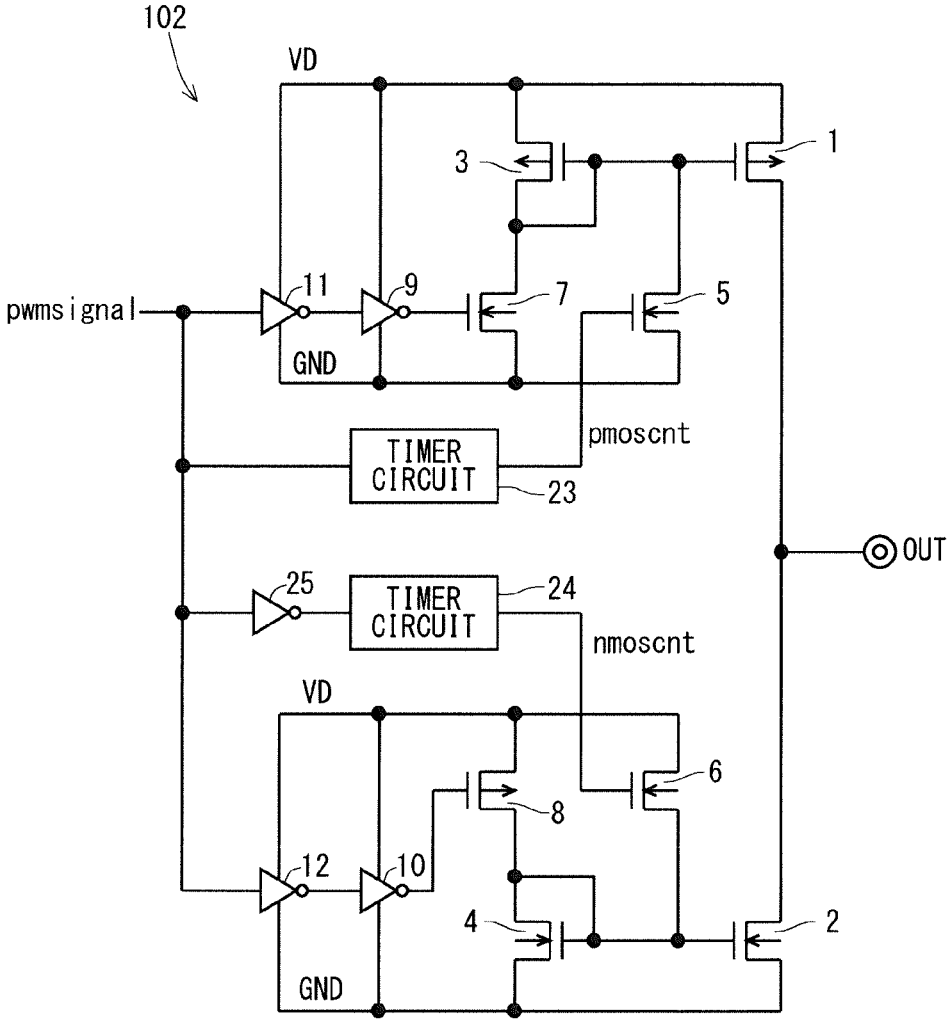
FIG. 6 is a circuit diagram of a drive circuit according to a second preferred embodiment of the present invention.

FIG. 6 is a circuit diagram of a drive circuit 102 according to a second preferred embodiment. The drive circuit 102 is provided with timer circuits 23 and 24 instead of the voltage monitoring circuits 17 and 18, respectively, in the configuration of the drive circuit 101 according to the first preferred embodiment. The drive circuit 101 compares the gate voltage with the threshold voltage in the voltage monitoring circuits 17, 18 and switches from the constant current drive to the on-resistance drive based on the comparison. On the other hand, the drive circuit 102 measures the time in the timer circuits 23, 24 and switches to the on-resistance drive after a predetermined time has elapsed from the start of the constant current drive.

The timer circuit 23 in the source side receives the control signal "pwmsignal" and supplies its output signal to the gate electrode of the N-channel MOSFET 5. The timer circuit 24 in the sink side receives the control signal "pwmsignal" through a NOT gate 25 and supplies its output signal to the gate electrode of the N-channel MOSFET 6.

<B-2. Operation>

The operation of the drive circuit 102 is described. When the logic level of the control signal "pwmsignal" changes from "L" to "H", the N-channel MOSFET 7 is turned on to start the constant current drive and the timer circuit 23 receives "H" to start counting. After the predetermined time has elapsed from the start of the constant current drive, the timer circuit 23 outputs "H", which turns on the N-channel MOSFET 5. This switches the mode to the on-resistance drive using the on-resistance of the P-channel MOSFET 1.

When the logic level of the control signal "pwmsignal" then changes from "H" to "L", the constant current drive is performed using the mirror current of the sink-side current mirror circuit. Additionally, the input to the timer circuit 24 goes "H" and the timer circuit 24 starts counting. After the predetermined time has elapsed from the start of the constant current drive, the timer circuit 24 outputs "H", which turns on the N-channel MOSFET 6. This switches the mode to the on-resistance drive using the on-resistance of the N-channel MOSFET 2.

<B-3. Advantageous Effects>

A control circuit includes the timer circuits 23, 24 for measuring the time from the start of the constant current drive in the drive circuit 102 of the second preferred embodiment. After the predetermined time has elapsed from the start of the constant current drive in the timer circuits 23 and 24, the N-channel MOSFETs 5 and 6 are turned on, respectively. This switches the mode to the on-resistance drive using the P-channel MOSFET 1 in the source side and switches to the on-resistance drive using the N-channel MOSFET 2 in the sink side.

<C. Third Preferred Embodiment>

<C-1. Configuration>

Figure 7:
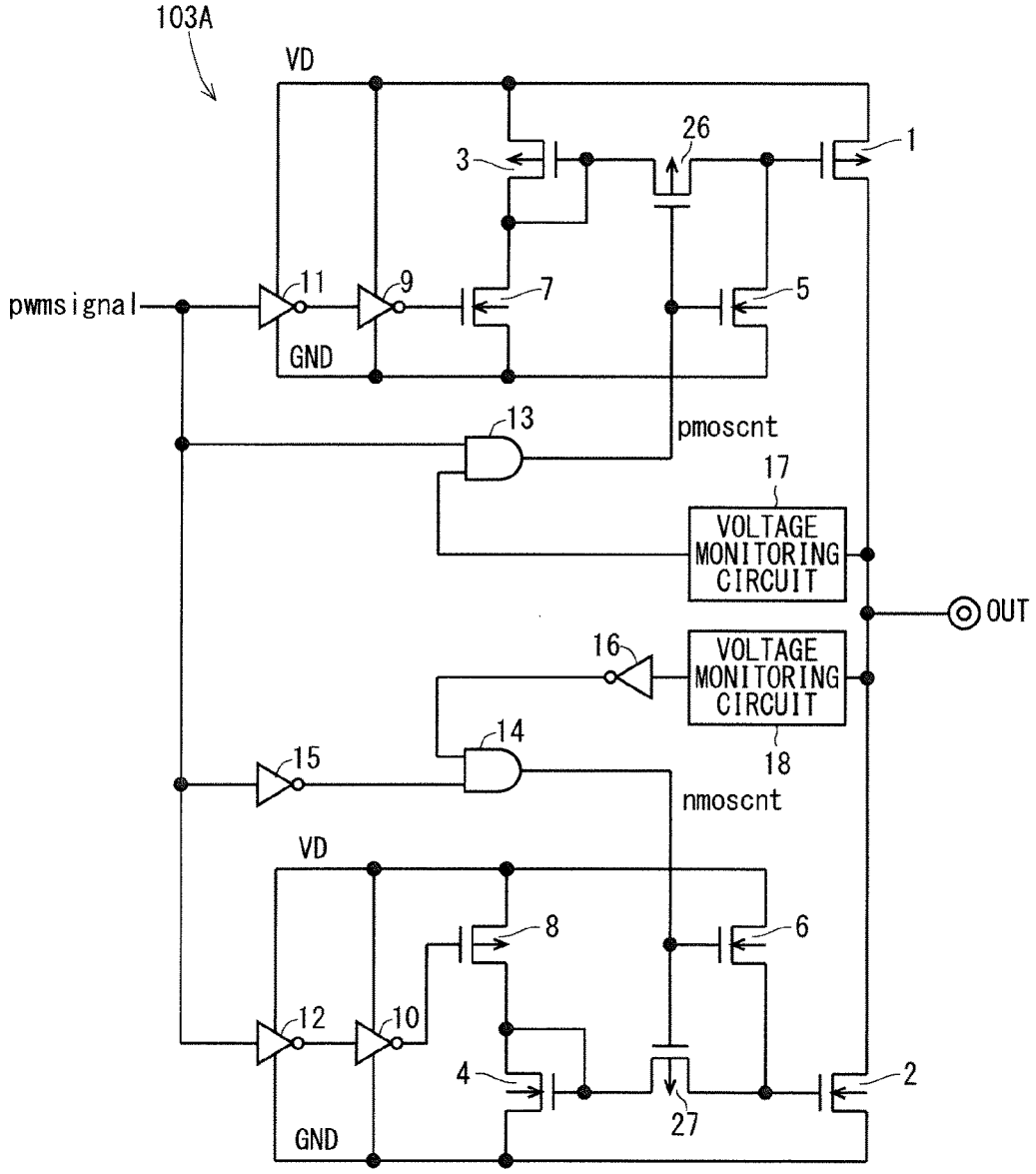
FIG. 7 is a circuit diagram of a drive circuit according to a third preferred embodiment of the present invention.

FIG. 7 is a circuit diagram of a drive circuit 103A according to a third preferred embodiment. The drive circuit 103A includes P-channel MOSFETs 26, 27 (second transistors) in addition to the components of the drive circuit 101 according to the first preferred embodiment.

A drain electrode and a source electrode of the P-channel MOSFET 26 are connected to the common control line of the current mirror circuit in the source side of the drive circuit 103A. A gate electrode of the P-channel MOSFET 26 is connected to the output terminal of the AND gate 13 and the gate electrode of the N-channel MOSFET 5.

A drain electrode and a source electrode of the P-channel MOSFET 27 are connected to the common control line of the current mirror circuit in the sink side of the drive circuit 103A. A gate electrode of the P-channel MOSFET 27 is connected to the output terminal of the AND gate 14 and the gate electrode of the N-channel MOSFET 6.

<C-2. Operation>

By turning on the N-channel MOSFET 5, the drive circuit 101 according to the first preferred embodiment drops the gate potential of the P-channel MOSFET 1 to the GND potential and switches the P-channel MOSFET 1 to the on-resistance drive operation. The series connection of the N-channel MOSFET 5 and the P-channel MOSFET 3, however, prevents the gate potential of the P-channel MOSFET 1 from falling to the GND potential. As such, the drive circuit 103A turns off the P-channel MOSFET 26 when turning on the N-channel MOSFET 5 and thus provides a configuration that disconnects the reference side of the current mirror circuit from the output side thereof. This allows the gate potential of the P-channel MOSFET 1 to smoothly fall to the GND potential.

The same is true about the sink-side configuration: The P-channel MOSFET 27 is turned off when the N-channel MOSFET 6 is turned on, and this allows the gate potential of the N-channel MOSFET 2 to smoothly rise to VD.

<C-3. Modifications>

Figure 8:
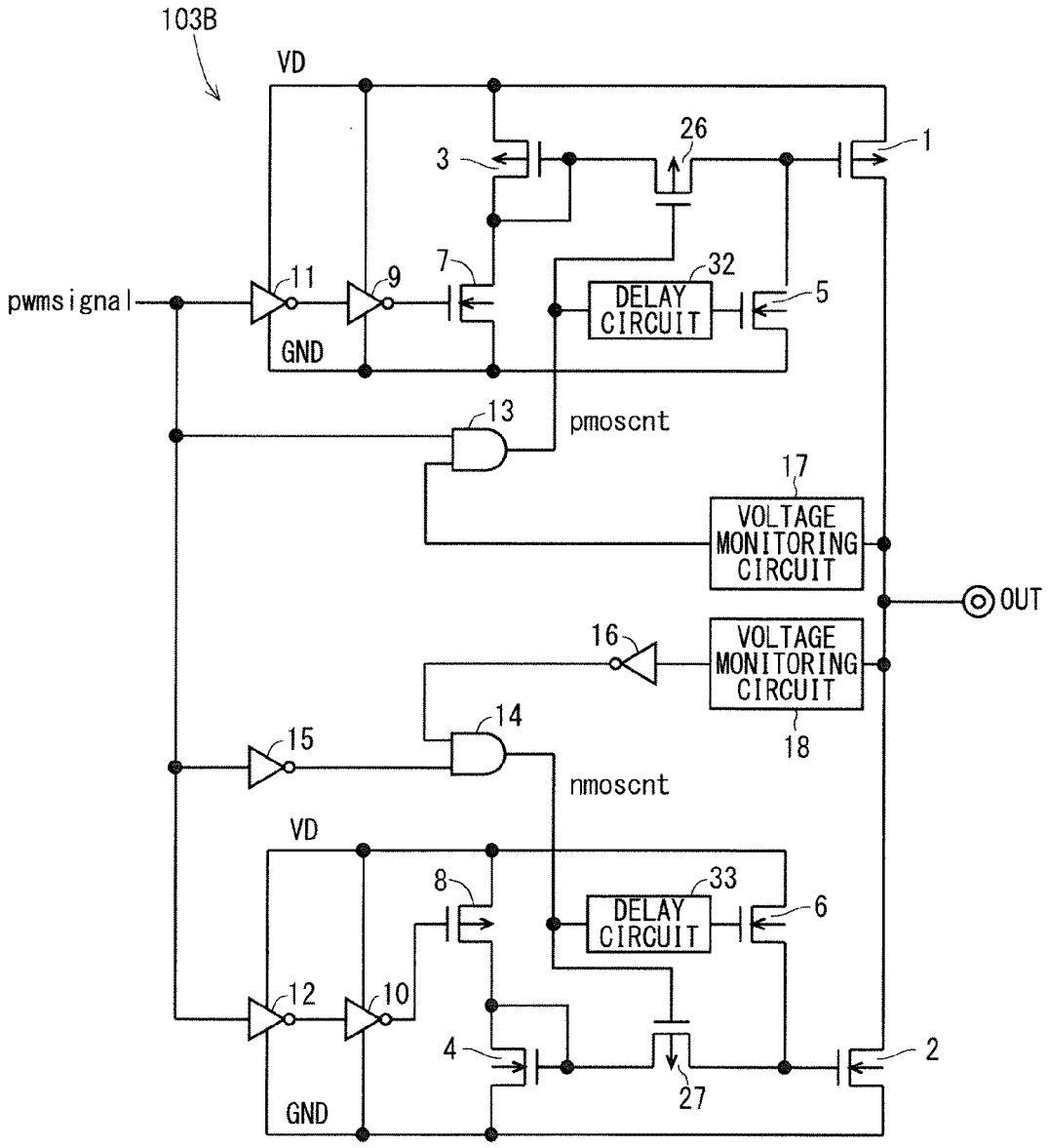
FIGS. 8 to 10 are circuit diagrams of drive circuits according to modifications of the third preferred embodiment of the present invention.

FIG. 8 shows a circuit diagram of a drive circuit 103B according to a first modification of the third preferred embodiment. The drive circuit 103B includes delay circuits 32, 33 in addition to the components of the drive circuit 103A. The delay circuit 32 is provided between the AND gate 13 and the gate electrode of the N-channel MOSFET 5 in the source side. The delay circuit 33 is provided between the AND gate 14 and the gate electrode of the N-channel MOSFET 6 in the sink side.

The delay circuit 32 provides a delay from the time the logic level of the output "pmoscnt" of the AND gate 13 is switched from "L" to "H" until the N-channel MOSFET 5 is turned on. Therefore, when the logic level of the output "pmoscnt" is switched from "L" to "H", the P-channel MOSFET 26 is turned off before the N-channel MOSFET 5 is turned on, and the reference side of the current mirror circuit is disconnected from the output side thereof. Thus, the P-channel MOSFET 1 can be reliably operated in the on-resistance drive mode.

The same is true about the sink-side operation: When the logic level of the output "nmoscnt" of the AND gate 14 is switched from "L" to "H", the P-channel MOSFET 27 is turned off before the delay circuit 33 causes the N-channel MOSFET 6 to be turned on, and the reference side of the current mirror circuit is disconnected from the output side thereof. Thus, the N-channel MOSFET 2 can be reliably operated in the on-resistance drive mode.

Figure 9:
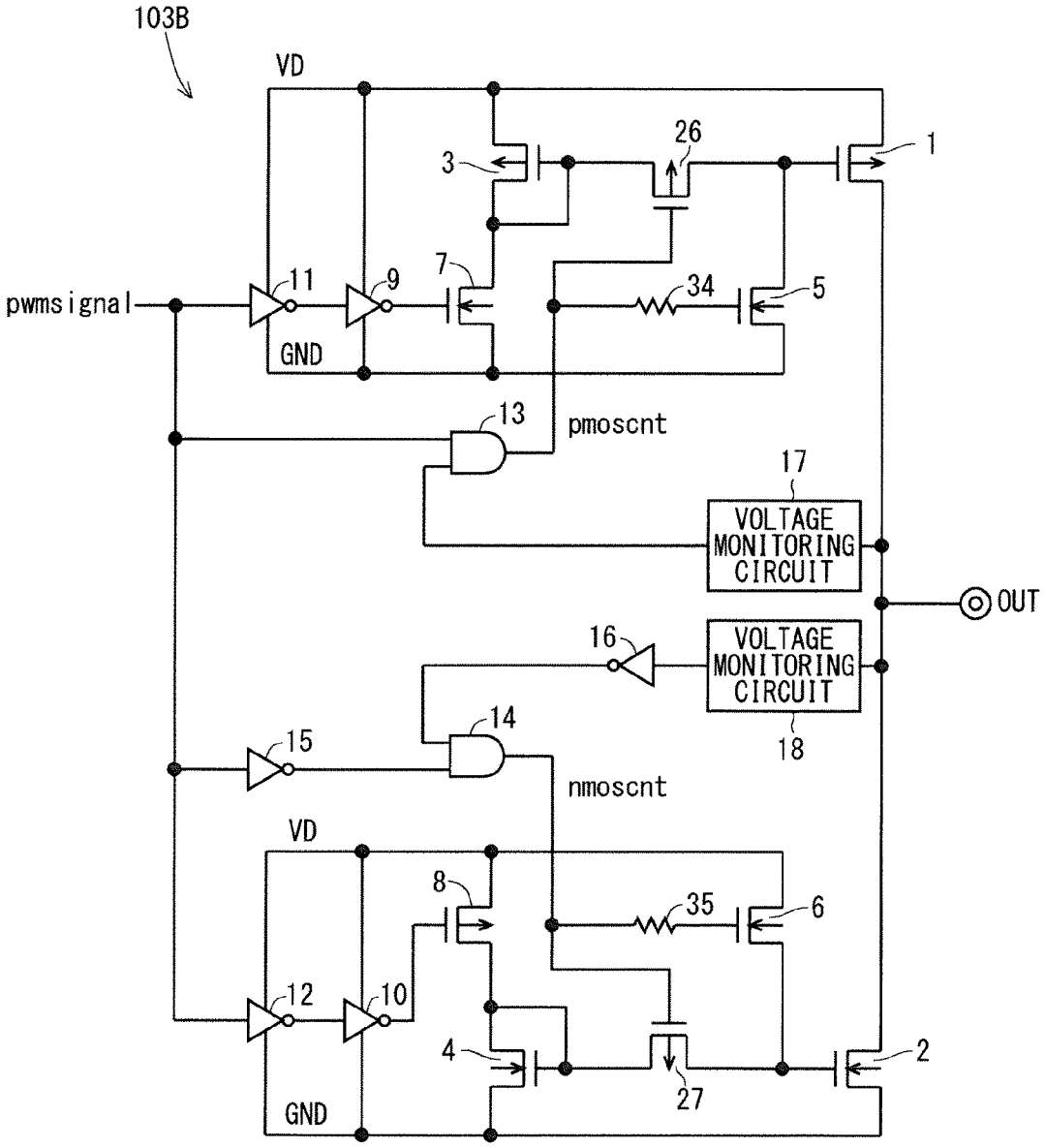

The delay circuits 32 and 33 may be comprised of gate resistance loads 34 and 35, respectively, as shown in FIG. 9.

Figure 10:
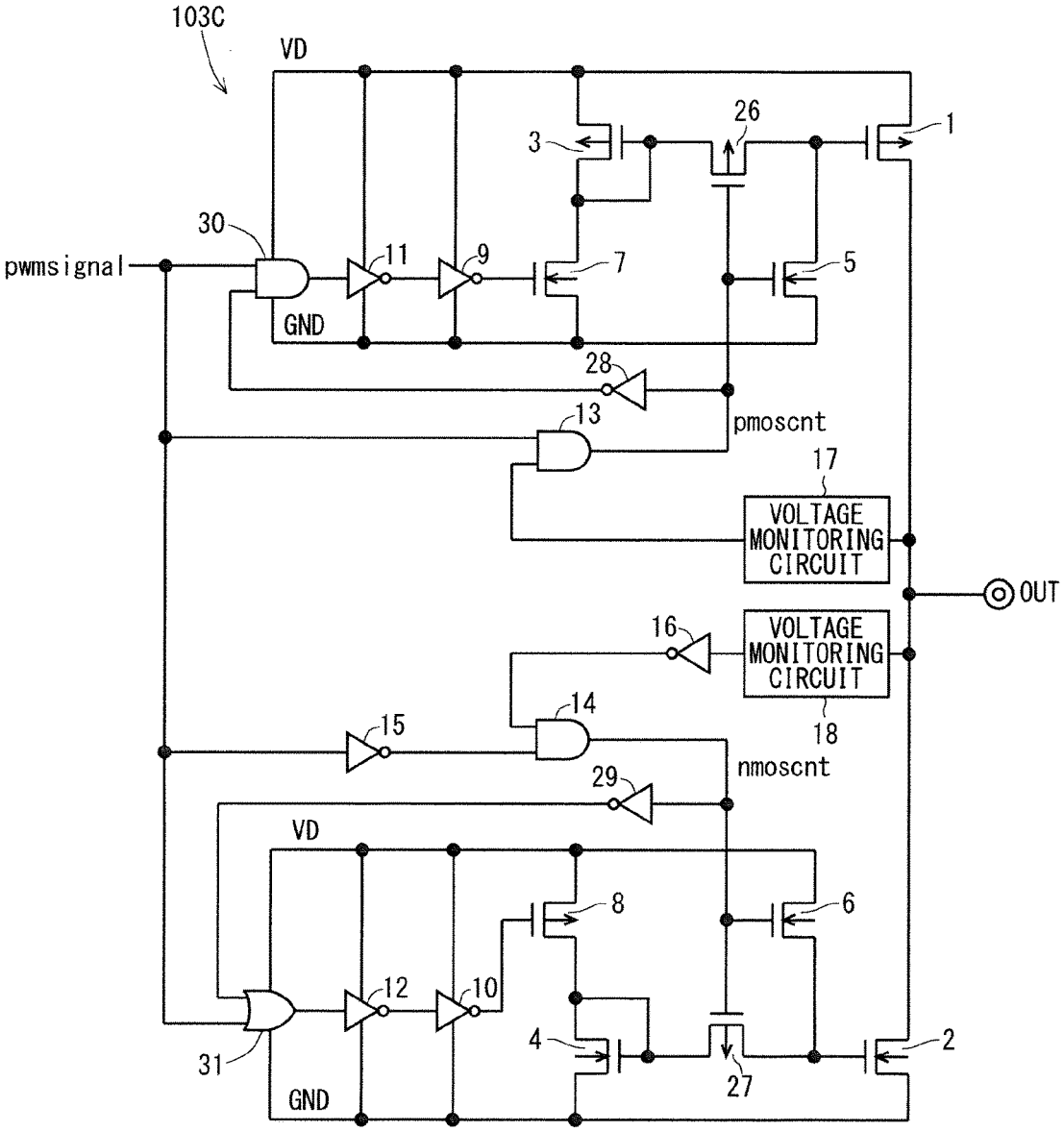

FIG. 10 is a circuit diagram of a drive circuit 103C according to a second modification of the third preferred embodiment. The drive circuit 103C includes, in addition to the components of the drive circuit 103A, a bias current control circuit that shuts off the bias current of the current mirror circuit upon transfer from the constant current drive to the on-resistance drive.

Specifically, the bias current control circuit includes, in the source side of the drive circuit 103C, a NOT gate 28 for receiving the output "pmoscnt" of the AND gate 13 and an AND gate 30 for receiving the output of the NOT gate 28. The AND gate 30 receives the control signal "pwmsignal" in addition to the output of the NOT gate 28 and the output of the AND gate 30 is input to the NOT gate 11.

The bias current control circuit includes, in the sink side of the drive circuit 103C, a NOT gate 29 for receiving the output "nmoscnt" of the AND gate 14 and an OR gate 31 for receiving the output of the NOT gate 29. The OR gate 31 receives the control signal "pwmsignal" in addition to the output of the NOT gate 29 and the output of the OR gate 31 is input to the NOT gate 12.

When the drive circuit 103C is transferred to the on-resistance drive on condition that the control signal "pwmsignal" is "H", the output "pmoscnt" of the AND gate 13 goes "H", at which time the AND gate 30 receives "L" through the NOT gate 28 and therefore the output of the AND gate 30 goes "L". Thus, the N-channel MOSFET 7 is turned off and, as a result, generates no bias current.

When the drive circuit 103C is transferred to the on-resistance drive on condition that the control signal "pwmsignal" is "L", the output "nmoscnt" of the AND gate 14 goes "H", at which time the OR gate 31 receives "L" through the NOT gate 29 and therefore the output of the OR gate 31 goes "L". Thus, the P-channel MOSFET 8 is turned off and, as a result, generates no bias current.

If the bias current is also generated after switching to the on-resistance drive, the circuit current would increase due to the bias current. However, turning off the N-channel MOSFET 7 and the P-channel MOSFET 8 prevents the circuit current from increasing.

<C-4. Advantageous Effects>

The drive circuit 103A according to the third preferred embodiment further includes the second transistor (P-channel MOSFET 26) a first current electrode (drain electrode) and a second current electrode (source electrode) of which are connected to the control line common to the reference transistor (P-channel MOSFET 3) and the output transistor (P-channel MOSFET 1), and a control electrode (gate electrode) of the second transistor is connected to a control electrode (gate electrode) of the first transistor (N-channel MOSFET 5). Thus, when the drive circuit 103A is switched to the on-resistance drive operation by turning on the first transistor, the reference side of the current mirror circuit is disconnected from the output side thereof so that the control potential of the output transistor is changed from the potential during mirror operation of the current mirror circuit, allowing the drive circuit 103A to be smoothly switched to the on-resistance drive.

The drive circuit 103B includes the delay circuit such as a resistor circuit between the control circuit and the first transistor (N-channel MOSFET 5) so that the reference side of the current mirror circuit can be disconnected from the output side thereof by the second transistor before the first transistor is turned on, allowing the drive circuit 103B to be smoothly switched to the on-resistance drive.

The drive circuit 103C includes the bias current control circuit (i.e., AND gate 30, NOT gate 28, OR gate 31, NOT gate 29) that turns off the third transistor (N-channel MOSFET 7) when the first transistor (N-channel MOSFET 5) is turned on, thereby preventing an increase in the circuit current due to the bias current in the on-resistance drive mode.

D. Fourth Preferred Embodiment

The drive circuit 101 according to the first preferred embodiment causes the P-channel MOSFET 1 to perform the on-resistance drive operation by turning on the N-channel MOSFET 5; however, in the meantime, the bias current flows from the N-channel MOSFET 7 in the reference side of the current mirror circuit, and this results in an increase of the circuit current.

As such, a drive circuit 104 according to a fourth preferred embodiment is configured such that no bias current flows in the on-resistance drive operation.

<D-1. Configuration>

Figure 11:
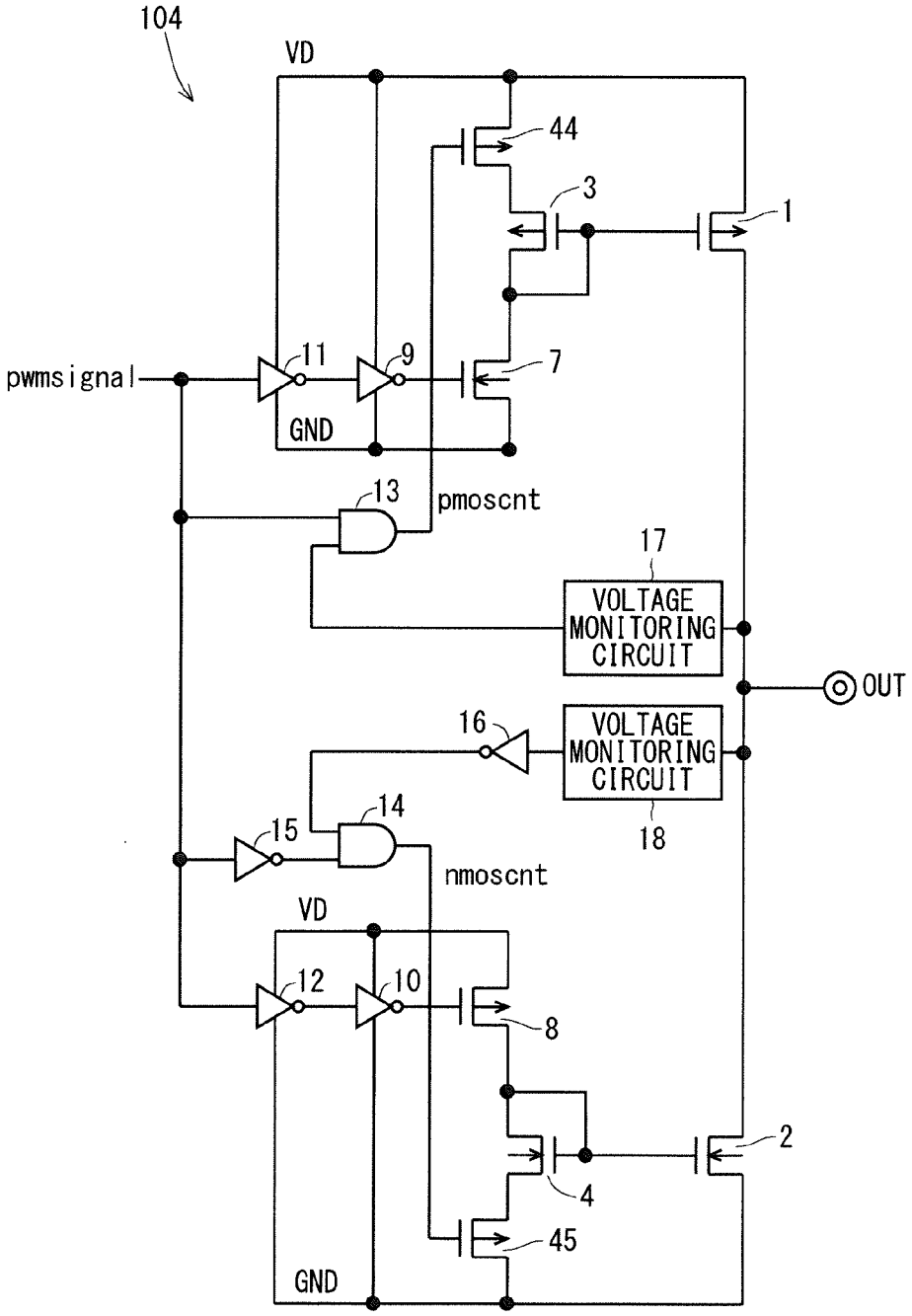
FIG. 11 is a circuit diagram of a drive circuit according to a fourth preferred embodiment of the present invention.

FIG. 11 is a circuit diagram of the drive circuit 104. In the drive circuit 101, the N-channel MOSFETs 5 and 6 or the first transistors are connected to the respective common control lines of the current mirror circuits. In the drive circuit 104, on the other hand, the first transistor is connected in series with the reference transistor (P-channel MOSFET 3, N-channel MOSFET 4) of the current mirror circuit. That is, a P-channel MOSFET 44 is connected in series with the P-channel MOSFET 3 and a P-channel MOSFET 45 is connected in series with the N-channel MOSFET 4.

The rest of the configuration of the drive circuit 101 is similar to that of the drive circuit 104: The output terminal of the AND gate 13 is connected to a gate electrode of the P-channel MOSFET 44 and the output terminal of the AND gate 14 is connected to a gate electrode of the P-channel MOSFET 45.

<D-2. Operation>

When the source-side operation switches the constant current drive to the on-resistance drive, the output "pmoscnt" of the AND gate 13 is switched from to "H", at which time the P-channel MOSFET 44 is turned off so that the reference side of the current mirror circuit is provided with a high impedance. Thus, no bias current flows from the N-channel MOSFET 7 and an increase in the circuit current can be prevented.

When the sink-side operation switches the constant current drive to the on-resistance drive, the output "nmoscnt" of the AND gate 14 is switched from "L" to "H", at which time the P-channel MOSFET 45 is turned off so that the reference side of the current mirror circuit is provided with a high impedance. Thus, no bias current flows from the P-channel MOSFET 8 and an increase in the circuit current can be prevented.

<D-3. Advantageous Effects>

In the drive circuit 104 according to the fourth preferred embodiment, the P-channel MOSFETs 44 and 45 are connected in series with the reference transistors (P-channel MOSFET 3 and N-channel MOSFET 4) of the current mirror circuits, respectively, serving as the first transistor of the potential change circuit. Upon transfer from the constant current drive to the on-resistance drive, the P-channel MOSFETs 44, 45 are turned off so that the reference side of the current mirror circuit is provided with a high impedance, thereby preventing the bias current from flowing. Thus, an increase in the circuit current can be prevented in the on-resistance drive mode.

<E. Fifth Preferred Embodiment>

<E-1. Configuration>

Figure 12:
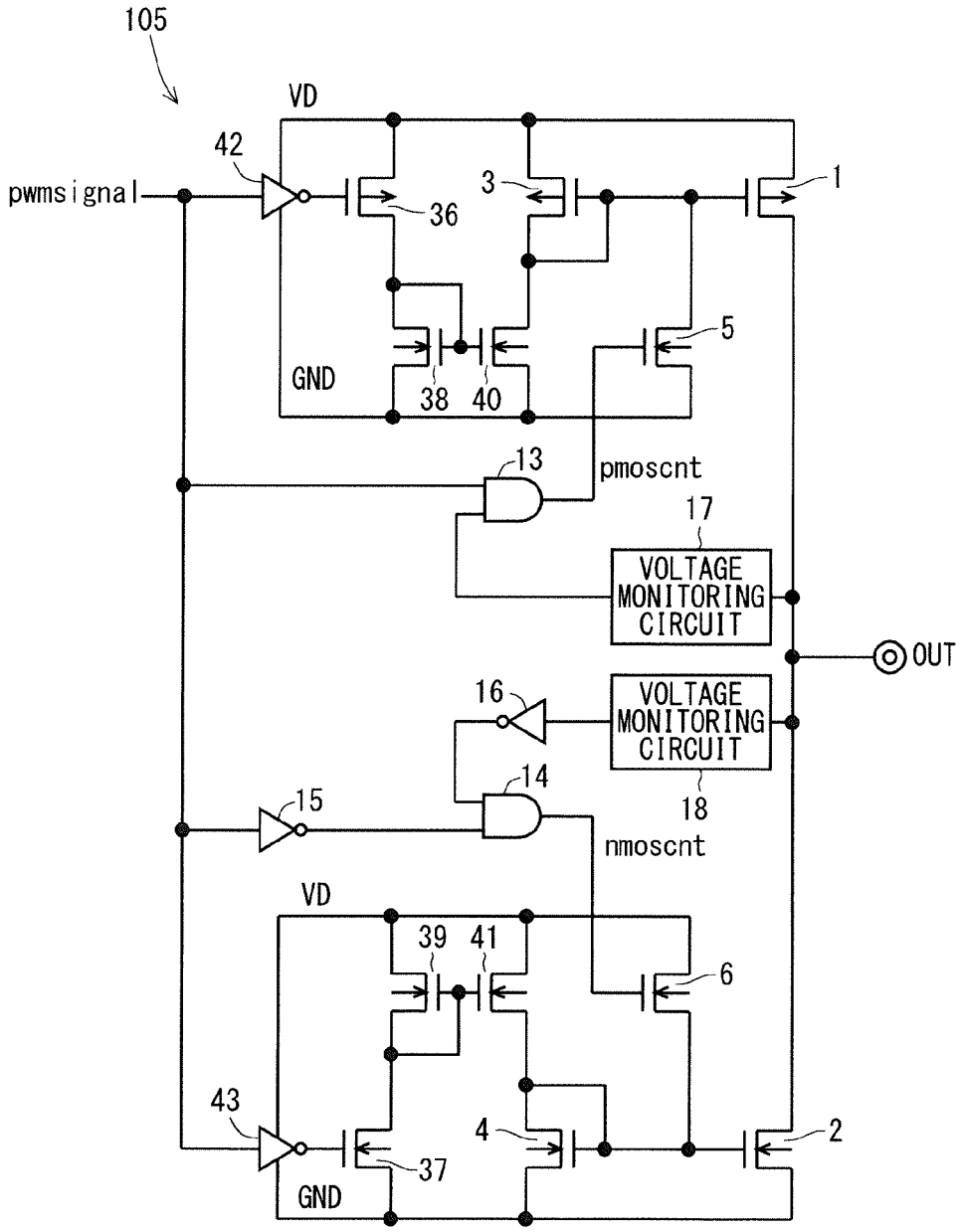
FIG. 12 is a circuit diagram of a drive circuit according to a fifth preferred embodiment of the present invention.

FIG. 12 is a circuit diagram of a drive circuit 105 according to a fifth preferred embodiment. The drive circuit 105 is provided with second current mirror circuits instead of the N-channel MOSFET 7 and the P-channel MOSFET 8 for generating the bias current of the current mirror circuit, in the configuration of the drive circuit 101.

For identification purposes, the current mirror circuit comprised of the P-channel MOSFETs 1, 3 is referred to as the first current mirror circuit.

The second current mirror circuit includes, in the source side of the drive circuit 105, an N-channel MOSFET 40 as an output transistor and an N-channel MOSFET 38 as a reference transistor that is connected to the N-channel MOSFET 40 in a current mirror manner and supplies a mirror current to the N-channel MOSFET 40. Specifically, gate electrodes of the N-channel MOSFET 38 and the N-channel MOSFET 40 are connected to each other, and a gate electrode and a drain electrode of the N-channel MOSFET 38 are short-circuited.

The N-channel MOSFET 40 is connected in series with the P-channel MOSFET 3. A drain electrode of the N-channel MOSFET 38 is connected in series with a P-channel MOSFET 36 (fourth transistor) for generating a bias current of the second current mirror circuit. The control signal "pwmsignal" is input to a gate electrode of the P-channel MOSFET 36 through a NOT gate 42.

The second current mirror circuit includes, in the sink side of the drive circuit 105, an N-channel MOSFET 41 as an output transistor and an N-channel MOSFET 39 as a reference transistor that is connected to the N-channel MOSFET 41 in a current mirror manner and supplies a mirror current to the N-channel MOSFET 41. Specifically, gate electrodes of the N-channel MOSFET 39 and the N-channel MOSFET 41 are connected to each other, and a gate electrode and a drain electrode of the N-channel MOSFET 39 are short-circuited.

The N-channel MOSFET 41 is connected in series with the N-channel MOSFET 4. A drain electrode of the N-channel MOSFET 39 is connected in series with an N-channel MOSFET 37 (fourth transistor) for generating a bias current of the second current mirror circuit. The control signal "pwmsignal" is input to a gate electrode of the N-channel MOSFET 37 through a NOT gate 43.

<E-2. Operation>

When the control signal "pwmsignal" goes "H", a logic level "L" is input to the gate of the P-channel MOSFET 36 through the NOT gate 42 in the source side of the drive circuit 105 and the P-channel MOSFET 36 is turned on. A drain current corresponding to the on-resistance of the P-channel MOSFET 36 is then generated as a bias current of the second current mirror circuit, and a current substantially equal to the bias current also flows through the output side of the second current mirror circuit.

The current flowing through the output side of the second current mirror circuit is also a reference current of the first current mirror circuit. Thus, the bias current of the P-channel MOSFET 36 controls the drain current of the P-channel MOSFET 1 in the constant current drive mode.

When the control signal "pwmsignal" goes "L", a logic level "H" is input to the gate of the N-channel MOSFET 37 through the NOT gate 43 in the sink side of the drive circuit 105 and the N-channel MOSFET 37 is turned on. A drain current corresponding to the on-resistance of the N-channel MOSFET 37 is then generated as a bias current of the second current mirror circuit, and a current substantially equal to the bias current also flows through the output side of the second current mirror circuit.

Thus, the bias current of the N-channel MOSFET 37 controls the drain current of the N-channel MOSFET 2 in the constant current drive mode.

The operation in the on-resistance drive mode is similar to that of the drive circuit 101.

<E-3. Advantageous Effects>

In the drive circuit 105 according to the fifth preferred embodiment, a bias current generating circuit includes the second current mirror circuit an output terminal of which is connected to an input terminal of the first current mirror circuit and the fourth transistor (P-channel MOSFET 36, N-channel MOSFET 37) connected to the input terminal of the second current mirror circuit. Such a configuration allows the P-channel MOSFET 36 (in the source side) and the N-channel MOSFET 37 (in the sink side) for controlling a current in the constant current drive mode to have the same polarity as the P-channel MOSFET 1 (in the source side) and the N-channel MOSFET 2 (in the sink side) for defining capability in driving at a constant voltage, respectively, thereby improving pairing properties.

<F. Sixth Preferred Embodiment>

<F-1. Configuration>

Figure 13:
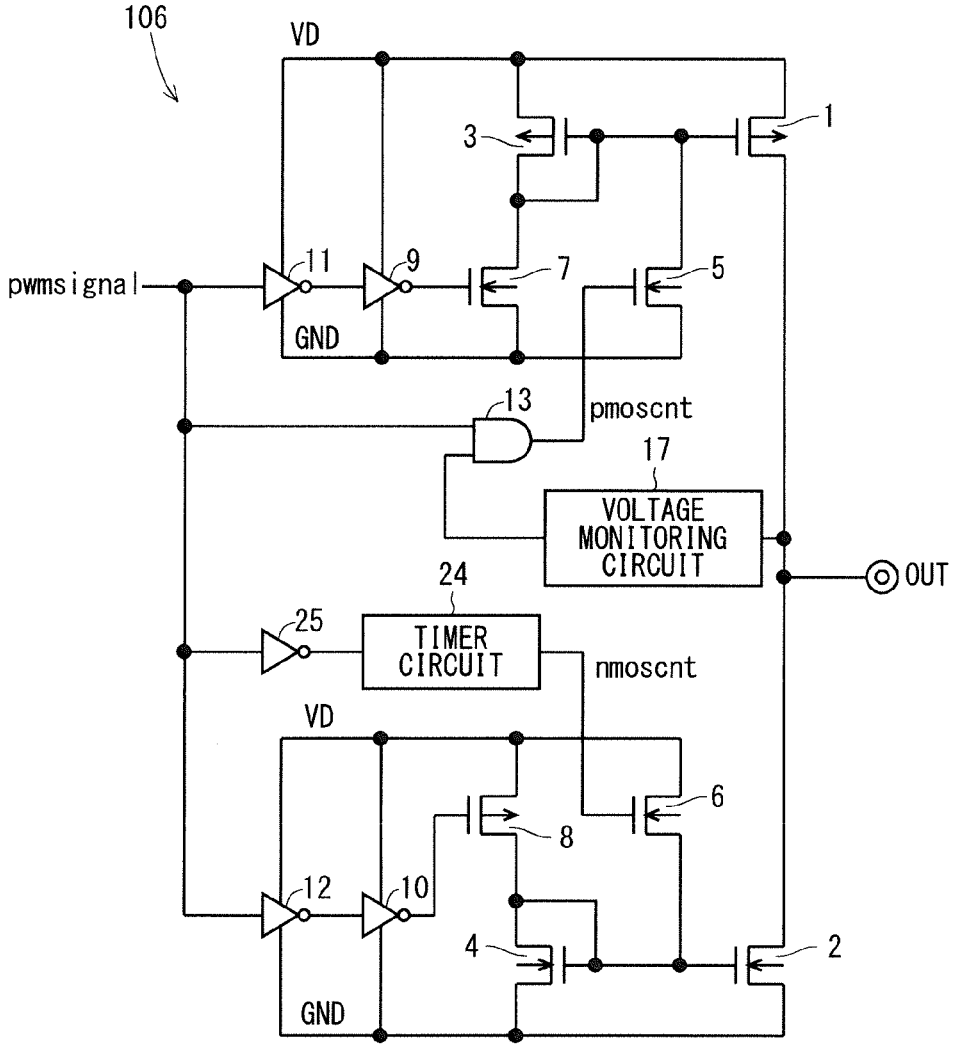
FIG. 13 is a circuit diagram of a drive circuit according to a sixth preferred embodiment of the present invention.

FIG. 13 is a circuit diagram of a drive circuit 106 according to a sixth preferred embodiment. The drive circuit 106 uses the drive circuit 101 as the source-side circuit and uses the drive circuit 102 as the sink-side circuit.

<F-2. Operation>

The voltage monitoring circuit monitors a gate voltage in the source side and switches to the constant voltage drive when the gate voltage exceeds the threshold voltage. On the other hand, the timer circuit 24 switches to the constant voltage drive in the sink side after a predetermined time has elapsed from the start of the constant current drive.

In the source side, noise degradation and loss degradation are determined, for example, by the threshold voltage and the mirror voltage of a semiconductor switching device. As such, the gate voltage is monitored and the drive mode is switched.

On the other hand, since there is a concern in the sink side that a surge voltage is generated, the feedback of the constant current drive is determined by timer control, thereby reducing the surge voltage.

<F-3. Advantageous Effects>

In the drive circuit 106 according to the sixth preferred embodiment, a control circuit, which controls whether the N-channel MOSFETs 5, 6 (first transistors) are turned on or off, includes in the source side of the drive circuit 106 the voltage monitoring circuit 17 for monitoring the control voltage of the switching device. When the voltage monitoring circuit 17 detects that the control voltage is greater than the threshold voltage, the voltage monitoring circuit 17 outputs "H" and turns on the N-channel MOSFET 5. On the other hand, the control circuit includes in the sink side of the drive circuit 106 the timer circuit 24 for measuring the time from the start of the constant current drive. After the predetermined time has elapsed from the start of the constant current drive, the timer circuit 24 outputs "H" and turns on the N-channel MOSFET 6. The drive circuit switches the drive mode in the source side by monitoring the control voltage, thus preventing the noise degradation and the loss degradation due to the change of the threshold voltage and the mirror voltage of the switching device. The feedback of the constant current drive is determined in the sink side by timer control, thereby reducing the surge voltage.

While the invention has been shown and described in detail, the foregoing description is in all aspects illustrative and not restrictive. It is therefore understood that numerous modifications and variations can be devised without departing from the scope of the invention.

What is claimed is:

1. A drive circuit for driving a switching device in response to a control signal, the drive circuit comprising:

a first current mirror circuit that comprises an output transistor connected to a control electrode of said switching device and a reference transistor that is connected to said output transistor in a current mirror manner and supplies a mirror current to said output transistor; and a potential change circuit that is connected to said reference transistor and changes a control potential of said output transistor from a potential during mirror operation of said first current mirror circuit, wherein said potential change circuit comprises:

a first transistor a first current electrode of which is connected to a control line common to said reference transistor and said output transistor; and a control circuit that controls whether said first transistor is turned on or off.

2. The drive circuit according to claim 1, wherein said control circuit comprises a voltage monitoring circuit for monitoring a control voltage of said switching device and switches said first transistor between conductive and non-conductive states by comparing said control voltage with a threshold voltage in said voltage monitoring circuit.

3. The drive circuit according to claim 2, wherein said voltage monitoring circuit is comprised of a logic device with a threshold.

4. The drive circuit according to claim 2, wherein said voltage monitoring circuit is comprised of a Schmitt circuit.

5. The drive circuit according to claim 2, wherein said voltage monitoring circuit is comprised of a comparator.

6. The drive circuit according to claim 1, wherein said control circuit comprises a timer circuit for measuring a time from the start of constant current drive, and said first transistor is turned on after a predetermined time elapses from the start of the constant current drive in said timer circuit.

7. The drive circuit according to claim 1, further comprising:

a second transistor a first current electrode and a second current electrode of which are connected to the control line common to said reference transistor and said output transistor, wherein a control electrode of said second transistor is connected to a control electrode of said first transistor.

8. The drive circuit according to claim 7, further comprising:

a delay circuit between said control circuit and said first transistor.

9. The drive circuit according to claim 8, wherein said delay circuit is a resistor circuit.

10. The drive circuit according to claim 1, further comprising:

a bias current generating circuit for generating a bias current that is supplied to said reference transistor.

11. The drive circuit according to claim 10, wherein said bias current generating circuit is a third transistor connected in series with said reference transistor.

12. The drive circuit according to claim 11, further comprising:

a bias current control circuit that turns off said third transistor when said first transistor is turned on.

13. The drive circuit according to claim 10, wherein said bias current generating circuit comprises:

a second current mirror circuit an output terminal of which is connected to an input terminal of said first current mirror circuit; and a fourth transistor connected to an input terminal of said second current mirror circuit.

14. The drive circuit according to claim 1, wherein said control circuit comprises:

in a source side of said drive circuit, a voltage monitoring circuit for monitoring a control voltage of said switching device, the voltage monitoring circuit switching said first transistor between conductive and non-conductive states when detecting that said control voltage is greater than a threshold voltage; and in a sink side of said drive circuit, a timer circuit for measuring a time from the start of constant current drive, the timer circuit switching said first transistor between conductive and non-conductive states after a predetermined time elapses from the start of the constant current drive.

15. A drive circuit for driving a switching device in response to a control signal, the drive circuit comprising:

a first current mirror circuit that comprises an output transistor connected to a control electrode of said switching device and a reference transistor that is connected to said output transistor in a current mirror manner and supplies a mirror current to said output transistor; and a potential change circuit that is connected to said reference transistor and changes a control potential of said output transistor from a potential during mirror operation of said first current mirror circuit, wherein said potential change circuit comprises:

a first transistor connected in series with said reference transistor; and a control circuit that controls whether said first transistor is turned on or off.

* * * * *